US005526784A

United States Patent [19]

Hakkenberg et al.

[11] Patent Number: 5,526,784

[45] Date of Patent: Jun. 18, 1996

[54] SIMULTANEOUS EXHAUST VALVE OPENING BRAKING SYSTEM

[75] Inventors: Pete Hakkenberg, Dunlap; James J. Faletti, Spring Valley; Dennis D. Feucht, Morton, all of Ill.

[73] Assignee: Caterpillar Inc., Peoria, Ill.

[21] Appl. No.: 285,978

[22] Filed: Aug. 4, 1994

[51] Int. Cl.[6] ..... F02D 13/04

[52] U.S. Cl. ..... 123/322; 123/321

[58] Field of Search ..... 123/320, 321, 123/322

[56] References Cited

U.S. PATENT DOCUMENTS

| | | | |
|---|---|---|---|
| Re. 33,052 | 9/1989 | Meistrick et al. | 123/321 |
| 1,947,996 | 2/1934 | Loeffler | 123/321 |
| 2,876,876 | 3/1959 | Cummins | 192/3 |
| 3,023,870 | 3/1962 | Udelman | 192/3 |
| 3,202,182 | 8/1965 | Haviland | 137/625.27 |
| 3,220,392 | 11/1965 | Cummins | 123/321 |
| 3,234,923 | 2/1966 | Fleck et al. | 123/321 |
| 3,254,743 | 6/1966 | Finger | 192/3 |
| 3,332,405 | 7/1967 | Haviland | 123/321 |
| 3,367,312 | 2/1968 | Jonsson | 123/321 |
| 3,405,699 | 10/1968 | Laas | 123/320 |

(List continued on next page.)

FOREIGN PATENT DOCUMENTS

| | | |
|---|---|---|
| 0139566 | 5/1985 | European Pat. Off. . |
| 0441100 | 2/1991 | European Pat. Off. . |
| 0455937 | 11/1991 | European Pat. Off. . |
| 2616481 | 12/1988 | France . |
| 2151331 | 4/1973 | Germany . |
| 3428626 | 2/1986 | Germany . |
| 2-223617 | 9/1990 | Japan . |
| 22762 | 2/1901 | United Kingdom . |
| 482990 | 12/1937 | United Kingdom . |
| 1229207 | 4/1971 | United Kingdom . |
| 91/03630 | 3/1991 | WIPO . |

OTHER PUBLICATIONS

Abstract of Japan Patent No. JP2125905, published May 14, 1990.

Abstract of Japan Patent No. JP3111611, published May 13, 1991.

Abstract of Japan Patent No. JP3117606, published May 20,1991.

Abstract of Japan Patent No. JP56047635, published Apr. 30,1981.

Abstract of Japan Patent No. JP57099239, published Jun. 19,1982.

Abstract of Japan Patent No. JP57099240, published Jun. 19,1982.

Abstract of Japan Patent No. JP57099242, published Jun. 19,1982.

Abstract of Japan Patent No. 59–170414 (A), published Sep. 26,1984.

Abstract of Japan Patent No. JP6002520, published Jan. 11, 1994.

Abstract of Japan Patent No. 60–75724 (A), published Apr. 30,1985.

SAE Paper No. 922448, "Jacobs New Engine Brake Technology, " by Z. Meistrick, Nov. 16–19, 1992.

*Primary Examiner*—Tony M. Argenbright

*Attorney, Agent, or Firm*—Marshall O'Toole Gerstein Murray and Borun

[57] ABSTRACT

An engine compression braking system for a multicylinder engine having a plurality of hydraulically operated exhaust valve actuators, one for each respective cylinder exhaust valve. An hydraulically operated braking control valve is operatively coupled to each of the exhaust valve actuators to in turn simultaneously open each associated exhaust valve. Selective fluid coupling and decoupling of hydraulic operating lines to the braking control valve enables a spool valve element to effectively float between an operating end point and a return end point to prevent the spool valve element from undesirably impacting the end point stops. The engine braking horsepower can be varied by timing the simultaneous opening of the exhaust valves and the duration of the opening.

18 Claims, 7 Drawing Sheets

OTHER PUBLICATIONS

| | | | |
|---|---|---|---|
| 3,520,287 | 7/1970 | Calvin | 123/321 |
| 3,525,317 | 8/1970 | Muir | 123/320 |
| 3,547,087 | 12/1970 | Siegler | 123/321 |
| 3,680,318 | 8/1972 | Nakajima et al. | 60/278 |
| 3,786,792 | 1/1974 | Pelizzoni et al. | 123/321 |
| 3,808,948 | 5/1974 | Glaze | 91/363 A |
| 3,809,033 | 5/1974 | Cartledge | 123/90.46 |
| 3,859,970 | 1/1975 | Dreisin | 123/320 |
| 3,982,507 | 9/1976 | Asaka et al. | 123/322 |
| 4,052,930 | 10/1977 | Hiramatsu et al. | 91/446 |
| 4,054,156 | 10/1977 | Benson | 137/630.12 |
| 4,062,332 | 12/1977 | Perr | 123/323 |
| 4,093,046 | 6/1978 | Perr | 188/273 |
| 4,114,643 | 9/1978 | Aoyama et al. | 137/495 |
| 4,138,849 | 2/1979 | Wilber | 60/602 |
| 4,150,640 | 4/1979 | Egan | 123/321 |
| 4,158,348 | 6/1979 | Mason et al. | 123/321 |
| 4,164,917 | 8/1979 | Glasson | 123/321 |
| 4,173,209 | 11/1979 | Jordan | 123/198 F |
| 4,174,687 | 11/1979 | Fuhrmann | 123/90.13 |
| 4,175,534 | 11/1979 | Jordan | 123/198 F |
| 4,188,933 | 2/1980 | Iizuka | 123/198 F |
| 4,201,362 | 5/1980 | Nishimi et al. | 251/29 |
| 4,215,723 | 8/1980 | Ichiryu et al. | 137/625.63 |
| 4,220,008 | 9/1980 | Wilber et al. | 60/602 |
| 4,223,649 | 9/1980 | Robinson et al. | 123/319 |
| 4,226,216 | 10/1980 | Bastenhof | 123/321 X |
| 4,251,051 | 2/1981 | Quenneville et al. | 251/129 |
| 4,271,796 | 6/1981 | Sickler et al. | 123/321 |
| 4,296,605 | 10/1981 | Price | 60/599 |
| 4,305,353 | 12/1981 | Robinson et al. | 123/333 |
| 4,333,430 | 6/1982 | Rosquist | 123/321 |
| 4,355,605 | 10/1982 | Robinson et al. | 123/320 |
| 4,363,301 | 12/1982 | Stock et al. | 123/321 |
| 4,367,702 | 1/1983 | Lassanske | 123/182 |
| 4,378,765 | 4/1983 | Abermeth et al. | 123/321 |
| 4,384,558 | 5/1983 | Johnson | 123/321 |
| 4,393,832 | 7/1983 | Samuel et al. | 123/327 |
| 4,395,884 | 8/1983 | Price | 60/602 |
| 4,398,510 | 8/1983 | Custer | 123/90.16 |
| 4,399,787 | 8/1983 | Cavanagh | 123/321 |
| 4,423,712 | 1/1984 | Mayne et al. | 123/321 |
| 4,429,532 | 2/1984 | Jakuba | 60/600 |
| 4,450,801 | 5/1984 | Thedens et al. | 123/198 F |
| 4,455,977 | 6/1984 | Kuczenski | 123/198 DC |
| 4,464,977 | 8/1984 | Brundage | 91/376 R |
| 4,466,390 | 8/1984 | Babitzka et al. | 123/90.16 |
| 4,473,047 | 9/1984 | Jukuba et al. | 123/323 |
| 4,474,006 | 10/1984 | Price et al. | 60/602 |
| 4,475,500 | 10/1984 | Bostelmann | 123/321 |
| 4,485,780 | 12/1984 | Price et al. | 123/321 |
| 4,494,726 | 1/1985 | Kumar et al. | 251/29 |
| 4,510,900 | 4/1985 | Quenneville | 123/321 |
| 4,553,732 | 11/1985 | Brundage et al. | 251/30.01 |
| 4,572,114 | 2/1986 | Sickler | 123/21 |
| 4,592,319 | 6/1986 | Meistrick | 123/321 |
| 4,596,271 | 6/1986 | Brundage | 137/540 |
| 4,648,365 | 3/1987 | Bostelman | 123/321 |
| 4,651,687 | 3/1987 | Yamashita et al. | 123/182 |
| 4,655,178 | 4/1987 | Meneely | 123/321 |
| 4,658,781 | 4/1987 | Guinea | 123/325 |
| 4,662,332 | 5/1987 | Bergmann et al. | 123/321 |
| 4,664,070 | 5/1987 | Meistrick et al. | 123/21 |
| 4,674,451 | 6/1987 | Rembold et al. | 123/90.16 |
| 4,688,384 | 8/1987 | Pearman et al. | 60/600 |
| 4,697,558 | 10/1987 | Meneely | 123/321 |
| 4,703,723 | 11/1987 | Tamba et al. | 123/182 |
| 4,706,624 | 11/1987 | Meistrick et al. | 123/321 |
| 4,706,625 | 11/1987 | Meistrick et al. | 123/321 |
| 4,711,210 | 12/1987 | Reichenbach | 123/321 |
| 4,741,307 | 5/1988 | Meneely | 123/321 |
| 4,741,364 | 5/1988 | Stoss et al. | 137/625.64 |
| 4,742,806 | 5/1988 | Tart, Jr. et al. | 123/322 |
| 4,765,288 | 8/1988 | Linder et al. | 123/90.16 |
| 4,793,307 | 12/1988 | Quenneville et al. | 123/323 |
| 4,794,890 | 1/1989 | Richeson, Jr. | 123/90.11 |
| 4,809,587 | 3/1989 | Kawahara et al. | 91/166 |
| 4,823,746 | 4/1989 | Kaplan | 123/145 A |
| 4,836,162 | 6/1988 | Melde-Tuczai et al. | 123/321 |
| 4,838,516 | 6/1989 | Meistrick et al. | 251/77 |
| 4,848,516 | 7/1989 | Meneely | 123/182 |
| 4,852,528 | 8/1989 | Richeson et al. | 123/90.11 |
| 4,858,956 | 8/1989 | Taxon | 251/129.07 |
| 4,873,948 | 10/1989 | Richeson et al. | 123/90.11 |
| 4,889,084 | 12/1989 | Rembold | 123/90.12 |
| 4,892,068 | 1/1990 | Coughlin | 123/182 |
| 4,898,128 | 2/1990 | Meneely | 123/90.12 |
| 4,898,133 | 2/1990 | Bader | 123/182 |
| 4,898,206 | 2/1990 | Meistrick et al. | 137/512.3 |
| 4,922,872 | 5/1990 | Nogami et al. | 123/319 |
| 4,932,372 | 6/1990 | Meneely | 123/182 |
| 4,936,273 | 6/1990 | Myers | 123/321 |
| 4,938,118 | 7/1990 | Wölfges et al. | 91/361 |
| 4,949,751 | 8/1990 | Meistrick et al. | 137/522 |
| 4,957,075 | 9/1990 | Hasegawa | 123/90.12 |
| 4,966,195 | 10/1990 | McCabe | 137/625.61 |
| 4,974,495 | 12/1990 | Richeson, Jr. | 91/459 |
| 4,981,119 | 1/1991 | Neitz et al. | 123/321 |
| 4,982,706 | 1/1991 | Rembold | 123/90.12 |
| 4,987,869 | 1/1991 | Hilburger | 123/323 |
| 4,996,957 | 3/1991 | Meistrick | 123/321 |
| 5,000,145 | 3/1991 | Quenneville | 123/321 |
| 5,000,146 | 3/1991 | Szucanyi | 123/321 |
| 5,000,280 | 3/1991 | Wazaki et al. | 180/197 |
| 5,012,778 | 5/1991 | Pitzi | 123/321 |
| 5,021,958 | 6/1991 | Tokoro | 364/426.04 |
| 5,022,358 | 6/1991 | Richeson | 123/90.12 |
| 5,022,359 | 6/1991 | Erickson et al. | 123/90.14 |
| 5,029,516 | 7/1991 | Erickson et al. | 91/459 |
| 5,036,810 | 8/1991 | Meneely | 123/321 |
| 5,036,811 | 8/1991 | Weiss et al. | 123/323 |
| 5,048,480 | 9/1991 | Price | 123/321 |
| 5,051,631 | 9/1991 | Anderson | 310/14 |
| 5,058,538 | 10/1991 | Erickson et al. | 123/90.12 |
| 5,086,738 | 2/1992 | Kubis et al. | 123/322 |
| 5,088,348 | 2/1992 | Hiramuki | 74/859 |
| 5,088,460 | 2/1992 | Echeverría | 123/322 |
| 5,105,782 | 4/1992 | Meneely | 123/321 |
| 5,113,812 | 5/1992 | Rembold et al. | 123/90.12 |
| 5,117,790 | 6/1992 | Clarke et al. | 123/321 |
| 5,121,324 | 6/1992 | Rini et al. | 364/431.05 |
| 5,121,723 | 6/1992 | Stepper et al. | 123/322 |
| 5,125,371 | 6/1992 | Erickson et al. | 123/90.12 |
| 5,127,375 | 7/1992 | Bowman et al. | 123/90.12 |
| 5,140,953 | 8/1992 | Fogelberg | 123/58 A |
| 5,140,955 | 8/1992 | Sono et al. | 123/90.15 |
| 5,146,754 | 9/1992 | Jain et al. | 60/602 |
| 5,146,890 | 9/1992 | Gobert et al. | 123/321 |
| 5,150,678 | 9/1992 | Wittmann et al. | 123/321 |
| 5,152,258 | 10/1992 | D'Alfonso | 123/90.12 |
| 5,152,260 | 10/1992 | Erickson et al. | 123/90.12 |
| 5,161,500 | 11/1992 | Kubis et al. | 123/321 |
| 5,161,501 | 11/1992 | Hu | 123/324 |
| 5,163,389 | 11/1992 | Fujiukawa et al. | 123/90.16 |
| 5,165,375 | 11/1992 | Hu | 123/321 |
| 5,168,848 | 12/1992 | Bergmann et al. | 123/324 |
| 5,183,018 | 2/1993 | Vittorio et al. | 123/321 |
| 5,184,586 | 2/1993 | Buchholz | 123/182.1 |
| 5,186,141 | 2/1993 | Custer | 123/321 |
| 5,191,827 | 3/1993 | Kervagoret | 91/433 |
| 5,193,494 | 3/1993 | Sono et al. | 123/90.12 |
| 5,195,489 | 3/1993 | Reich | 123/321 |

5,197,422 3/1993 Oleksy et al. ..... 123/182.1
5,201,290 4/1993 Hu ..... 123/321
5,215,054 6/1993 Meneely ..... 123/320
5,218,818 6/1993 Ahmann ..... 60/286
5,224,683 7/1993 Richeson ..... 251/30.01
5,248,123 9/1993 Richeson et al. ..... 251/29
5,253,619 10/1993 Richeson et al. ..... 123/90.12
5,255,650 10/1993 Faletti et al. ..... 123/322
5,257,605 11/1993 Pawellek et al. ..... 123/321
5,273,013 12/1993 Kubis et al. ..... 123/321
5,282,443 2/1994 Fujiyoshi et al. ..... 123/90.16
5,309,881 5/1994 Pawellek et al. ..... 123/321
5,386,809 2/1995 Reedy et al. ..... 123/320

SIMULTANEOUS EXHAUST VALVE OPENING BRAKING SYSTEM

TECHNICAL FIELD

The present invention relates generally to engine retarding systems and methods and, more particularly, to engine compression braking systems and components using electronically controlled actuation of the engine exhaust valves.

BACKGROUND ART

Engine brakes or retarders are used to assist and supplement wheel brakes in slowing heavy vehicles, such as tractor-trailers. Engine brakes are desirable because they help alleviate wheel brake overheating. As vehicle design and technology have advanced, the hauling capacity of tractor-trailers has increased, while at the same time rolling resistance and wind resistance have decreased. Thus, there is a need for advanced engine braking systems in today's heavy vehicles.

Problems with existing engine braking systems include high noise levels and a lack of smooth operation at some braking levels resulting from the use of less than all of the engine cylinders in a compression braking scheme. To maximize fuel economy, tractor-trailers are typically operated at a relatively low engine speed, i.e. 1300 RPM. Existing braking systems are only marginally effective at such low engine speeds and often the driver must downshift to obtain acceptable engine braking performance. Also, existing systems are not readily adaptable to differing road and vehicle conditions. Still further, existing systems are complex and expensive.

Known engine compression brakes convert an internal combustion engine from a power generating unit into a power consuming air compressor.

One type of engine compression braking system utilizes an exhaust brake valve which is disposed within the exhaust pipe of an internal combustion engine. Such a system is disclosed in U.S. Pat. No. 4,054,156 issued to Benson on Oct. 18, 1977. The exhaust brake valve increases back pressure in the exhaust system by restricting the flow of exhaust in the exhaust pipe, and thereby increases the amount of work required to rotate the engine.

U.S. Pat. No. 3,220,392 issued to Cummins on Nov. 30, 1965, discloses an engine braking system in which an exhaust valve located in a cylinder is opened when the piston in the cylinder nears the top dead center (TDC) position on the compression stroke. An actuator includes a master piston, driven by a cam and pushrod, which in turn drives a slave piston to open the exhaust valve during engine braking. The braking that can be accomplished by the Cummins device is limited because the timing and duration of the opening of the exhaust valve is dictated by the geometry of the cam which drives the master piston and hence these parameters cannot be independently controlled.

U.S. Pat. No. 3,234,923 issued to Fleck et al. on Feb. 15, 1966, discloses a mechanically driven engine braking system which selectively advances the timing of the opening of exhaust valves of the engine when the engine is in a braking mode. This timing change is accomplished by rotating the exhaust camshaft of the engine with respect to the crankshaft when engine braking is desired. This effectively converts the engine from a four cycle mode to a two cycle mode wherein blow-down and intake occur during each revolution of the crankshaft.

U.S. Pat. No. 4,150,640 issued to Egan on Apr. 24, 1979, discloses an engine braking system which uses a fuel injector rocker arm to drive an hydraulic actuator which opens a pair of exhaust valves associated with a combustion chamber near the end of the compression stroke of the piston. A pressure regulating valve is used to limit the force applied to the exhaust valves by the actuator in order to ensure that the exhaust valves are not subjected to excessive loads due to the force applied by the actuator and pressure forces in the combustion chamber. The pressure regulating valve delays opening of the exhaust valves by the actuator until the level of pressure in the combustion chamber is below a level at which the exhaust valves would be subjected to excessive loading.

U.S. Pat. No. 4,981,119 issued to Neitz et al. on Jan. 1, 1991, discloses a method of two cycle compression braking in which the exhaust valve is opened at the beginning and the end of the compression stroke, and at the beginning and the end of the exhaust stroke. Pressure is maintained in the exhaust manifold by a butterfly valve-type damper disposed in the exhaust pipe or manifold. Compared to a method in which the exhaust valve is opened at the end of the compression and exhaust stroke, the method of Neitz '119 increases the initial pressure within the engine cylinder at the beginning of the compression and exhaust strokes, thereby increasing the braking power of the engine.

U.S. Pat. No. 4,741,307 issued to Meneely on May 3, 1988, discloses a method and apparatus for braking a six cylinder engine in which a first exhaust valve associated with a first cylinder near TDC on the compression stroke is opened simultaneously with that of a second exhaust valve associated with a second cylinder near bottom dead center (BDC) on the intake stroke. In addition, a third exhaust valve associated with a third cylinder near BDC on the exhaust stroke is opened, as it would be under normal operating conditions. The method and apparatus disclosed in Meneely '307 simultaneously opens each exhaust valve associated with a set of three cylinders whenever any one of the cylinders in the set is near TDC on the compression stroke.

In conjunction with the increasingly widespread use of electronic controls in engine systems, engine braking systems have been developed which are electronically controlled by a central engine control unit.

For example, U.S. Pat. No. 5,121,324 issued to Rini et al. on Jun. 9, 1992, discloses the use of an electronic fuel injection control module which includes output signals which activate and deactivate an engine braking system when appropriate. The control module prevents the engine brake from being activated when fuel is being injected into the engine.

U.S. Pat. No. 5,121,723 issued to Stepper et al. on Jun. 16, 1992, discloses an electronic control unit which activates an engine brake only when inputs from various sensors indicate that conditions are appropriate for the activation of the engine brake.

U.S. Pat. No. 5,117,790 issued to Clarke et al. on Jun. 2, 1992, and assigned to the assignee of the present application, discloses a control system and a method for controlling the operation of an internal combustion engine in a number of modes. The control system is capable of controlling fuel injection timing and quantity, and inlet and exhaust valve opening and closing independently for each engine cylinder. The control system is also capable of operating the engine in either a four cycle braking mode or a two cycle braking mode.

U.S. Pat. No. 4,664,070 issued to Meistrick et al. on May 12, 1987, discloses an electronically controlled hydromechanical overhead apparatus which is capable of opening and closing exhaust and intake valves without utilizing a rocker arm mechanism. The overhead apparatus is capable of operating the exhaust and intake valves in a two-cycle retarding mode.

U.S. Pat. No. 5,088,348 issued to Hiramuki on Feb. 18, 1992, discloses an engine braking system used in conjunction with an automatic transmission. The electronic controller ensures that the engine brake is deactivated when the automatic transmission is shifting gears.

U.S. Pat. No. 5,086,738 issued to Kubis et al. on Feb. 11, 1992, also discloses the use of an electronic controller to activate and deactivate an engine brake. The electronic controller selectively energizes a solenoid valve which places an exhaust valve in mechanical communication with an exhaust cam which includes a secondary raised portion to open the exhaust valve at the appropriate time during engine braking. When the engine brake is not operating, the electronic controller is not energized and the movement of the exhaust pushrod and rocker arm due to the secondary raised portion of the exhaust cam is taken up by a gap or lash between the exhaust rocker arm and the exhaust valve.

Even more sophisticated systems use electronic control not only to activate and deactivate an engine braking system, but also to optimize the performance of the engine braking system.

U.S. Pat. No. 5,012,778 issued to Pitzi on May 7, 1991, discloses an engine braking system which includes a solenoid actuated servo valve hydraulically linked to an exhaust valve actuator. Hydraulic pressure (on the order of 3000 psi) is supplied by a high pressure hydraulic pump which supplies a high pressure plenum. A pressure regulator disposed between the high pressure hydraulic pump and the high pressure plenum maintains operating hydraulic pressure below a desired limit.

The servo valve disclosed in Pitzi '778 includes a high pressure source duct leading from the high pressure plenum, an actuator duct leading from the servo valve to the exhaust valve actuator and a drain duct. The servo valve has two operating positions. In a first or closed position, the high pressure duct is blocked and the actuator duct is in fluid communication with the drain duct. In this first position, pressure in the exhaust valve actuator is relieved through the drain duct to place the exhaust valve actuator in a rest position out of contact with the exhaust valve. In a second or open position, the drain duct is blocked and the high pressure duct is in fluid communication with the exhaust valve actuator.

The exhaust valve actuator disclosed in Pitzi '778 comprises a piston which, when subjected to sufficient hydraulic pressure, is driven into contact with a contact plate attached to an exhaust valve stem, thereby opening the exhaust valve. An electronic controller activates the solenoid of the servo valve. A group of switches are connected in series to the controller and the controller also receives inputs from a crankshaft position sensor and an engine speed sensor.

U.S. Pat. No. 5,255,650 issued to Faletti et al. on Oct. 26, 1993, and assigned to the assignee of the present application, discloses an electronic control system which is programmed to operate the intake valves, exhaust valves, and fuel injectors of an engine according to two predetermined logic patterns. According to a first logic pattern, the exhaust valves remain closed during each compression stroke. According to a second logic pattern, the exhaust valves are opened as the piston nears the TDC position during each compression stroke. The opening position, closing position, and the valve lift are all controlled independently of the position of the engine crankshaft.

U.S. Pat. No. 4,572,114 issued to Sickler on Feb. 25, 1986, discloses an electronically controlled engine braking system. A pushtube of the engine reciprocates a rocker arm and a master piston so that pressurized fluid is delivered and stored in a high pressure accumulator. For each engine cylinder, a three-way solenoid valve is operable by an electronic controller to selectively couple the accumulator to a slave bore having a slave piston disposed therein. The slave piston is responsive to the admittance of the pressurized fluid from the accumulator into the slave bore to move an exhaust valve crosshead and thereby open a pair of exhaust valves. The use of an electronic controller allows braking performance to be maximized independent of restraints resulting from mechanical limitations. Thus, the valve timing may be varied as a function of engine speed to optimize the retarding horsepower developed by the engine.

Electrically controlled hydraulic devices are known in the art which are capable of opening and closing engine intake and exhaust valves. For example, U.S. Pat. No. 5,224,683 issued to Richeson on Jul. 6, 1993, discloses an electrically controlled hydraulic actuator comprising a magnetically actuated pilot valve which selectively supplies hydraulic pressure to open an exhaust or intake valve of an engine. The position of the pilot valve is controlled by signals from a central engine computer.

U.S. Pat. No. 5,248,123 issued to Richeson et al. on Sep. 28, 1993, discloses an electronically controlled hydraulic valve actuator having a pilot valve which is electrically controlled via a solenoid, an intermediate valve which is moveable to supply fluid to the exhaust or intake valve of the engine, and an initializer valve which decelerates the exhaust or intake valve as it opens.

U.S. Pat. No. 4,974,495 issued to Richeson, Jr. on Dec. 4, 1990, discloses an electrically controlled hydraulically powered valve actuator capable of actuating an intake or exhaust valve of an internal combustion engine. The valve actuator uses magnetic latching to retain the valve actuator in one of two stable positions.

U.S. Pat. No. 5,022,358 issued to Richeson on Jun. 11, 1991, discloses a valve similar to the Richeson, Jr. '495 valve which also includes the capability to store the energy produced when the valve actuator opens the exhaust or intake valve. This energy is used to close the exhaust or intake valve.

U.S. Pat. No. 5,022,359 issued to Erickson et al. on Jun. 11, 1991, and U.S. Pat. No. 5,029,516 issued to Erickson et al. on Jul. 9, 1991, disclose electronically controlled actuator valves which may be used to open and close intake and exhaust valves of an internal combustion engine. The advantageous characteristics of these electronically controlled actuator valves include their fast acting capability, the fact that they can be used instead of a cam driven actuator valve and that they provide a desired flexibility in valve control during the engine braking mode. The elimination of a camshaft simplifies the engine and increases reliability due to the reduction in moving parts.

It is desired to provide an economical engine compression braking system providing increased braking performance and reliable operation over extended operating conditions.

DISCLOSURE OF THE INVENTION

In accordance with the principles of the present invention, there is provided apparatus and a method for engine compression braking using simultaneous actuation of the engine exhaust valves. The engine compression braking system of the present invention includes an exhaust valve actuator coupled to a respective engine cylinder exhaust valve on a multi-cylinder engine. Upon entering the engine braking mode, each of the exhaust valve actuators will be operated simultaneously to yield multiple openings of the exhaust valves in each cylinder during each revolution. One exhaust valve opening will occur in the vicinity of piston TDC to provide the compression release which performs the engine braking function. Since during this same period, the exhaust valve of adjacent cylinders are simultaneously opened, some of the air released in the compression release process will flow into those cylinders raising their pressures significantly over the level that can be induced from the average manifold conditions. Raising these pressures while still in the early stages of the compression stroke will significantly increase the pressures during the balance of the compression stroke which thus will increase the braking power.

In one embodiment of the invention, a plurality of hydraulically operated exhaust valve actuators, each having an hydraulic input and each coupled to a respective cylinder exhaust valve is provided for opening the respective exhaust valve upon hydraulic operation of the associated exhaust valve actuator. An hydraulic manifold has a single input and multiple outputs, each coupled respectively to an associated exhaust valve actuator. A single braking control valve actuator has a controlled hydraulic output coupled to the hydraulic manifold input. Upon entering the engine braking mode, a control signal is supplied to operate a braking control valve actuator to simultaneously hydraulically operate each of the exhaust valve actuators and in turn simultaneously open each associated exhaust valve. The intake valves simultaneously operate in the two cycle mode in synchronism with the exhaust valve action to enable complete cylinder filling on each stroke to maximize the braking capability of the engine.

The braking control valve actuator includes an hydraulically operated spool valve for operably interconnecting the hydraulic manifold input with an hydraulic high pressure supply. Hydraulically operating the spool valve in one direction enables fluid communication of the hydraulic manifold input with the hydraulic high pressure supply. A return spring returns the spool valve to a position blocking the fluid communication between the hydraulic manifold input and the hydraulic high pressure supply and opening a fluid communication between the hydraulic manifold and the engine oil sump.

A preferred embodiment of the braking control valve includes means for preventing undesired impact between the rapidly driven spool valve element and the valve housing. Because the spool valve is rapidly moved during valve operation by a high pressure hydraulic fluid driving force, repetitive impact of the spool valve into the valve housing must be prevented. A fluid decoupling configuration is provided wherein after the spool valve has been operatively driven the desired distance in one direction the high pressure hydraulic fluid is decoupled from driving engagement with the spool valve element. A spring is provided to prevent the momentum of the moving spool valve from causing the spool valve to impact the valve housing after the hydraulic fluid has been decoupled. In the return direction a check valve rapidly bleeds the high pressure hydraulic fluid from the driving chamber to a sump and allows a small amount of fluid to remain in the driving chamber so as to act as a cushion during the spool valve return. Thus, the spool valve can be rapidly moved by the high pressure hydraulic fluid during operation, and is still enabled to float between its operating end points to prevent undesired contact with the valve housing or other valve components.

A significant advantage of the engine compression braking system using simultaneous exhaust valve actuation of the present invention is the increased amount of engine braking power and the increased range of engine braking power attainable as a function of the timing of the simultaneous actuation of the exhaust valves opening and the duration of the exhaust valves opening. For a given engine RPM, using simultaneous exhaust valve actuation in the engine compression braking system of this invention provides almost four times more braking horsepower compared to the braking power produced solely by motoring friction, i.e., without the use of an engine brake.

For example, motoring friction in an exemplary engine at 2100 RPM can produce about 125 braking horsepower. In contrast, using simultaneous exhaust valve actuation in an engine compression braking system at 2100 RPM with 2 mm. exhaust valve lift: (1) occurring at about 40 degrees before TDC and with about 50 degrees duration provides about 475 braking horsepower; or (2) occurring at about 37 degrees before TDC and with about 40 degrees duration also can provide about 475 braking horsepower; or (3) occurring at about 28 degrees before TDC and with about 30 degrees duration also can provide about 475 braking horsepower.

Accordingly, this compression braking system offers significant flexibility in not only providing substantially increased engine braking performance, but also in providing the ability of reducing and controlling the braking level so as to enable custom fitting the braking power to a given application.

BEST MODE FOR CARRYING OUT THE INVENTION

Figure 1:
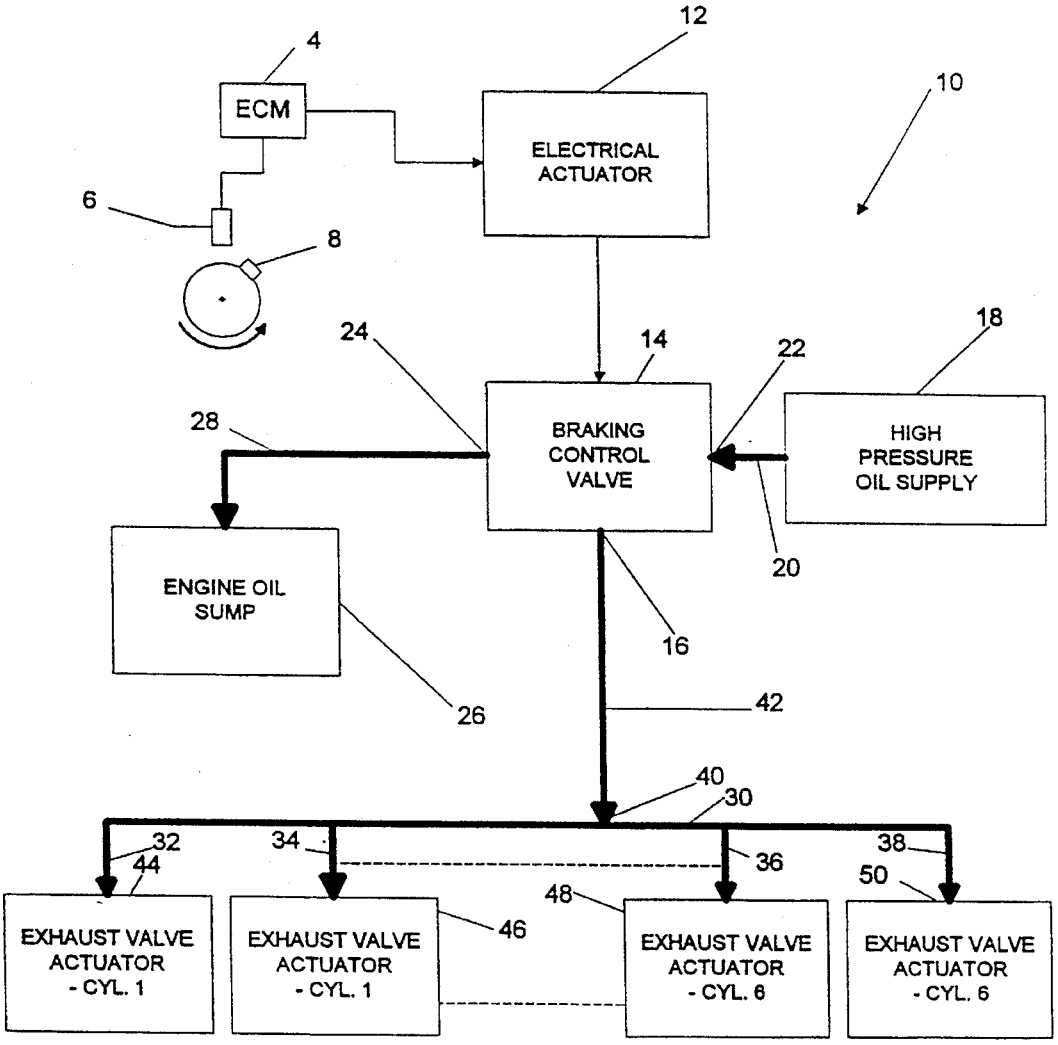
FIG. 1 is a schematic block diagram illustrating the engine compression braking system of the present invention.

Referring now to FIG. 1, there is illustrated an engine compression braking system 10 for a multi-cylinder engine wherein compressed air used during the compression stroke is used for engine braking and the compressed air is released through the cylinder exhaust valve near piston TDC. When the engine braking mode is entered, an appropriate timing output signal is supplied from an electronic engine control module (ECM) 4 receiving a timing signal from a sensor 6 sensing a crankshaft position indicator 8 which is correlated to the TDC position of each piston. The ECM 4 timing output signal is coupled to an electrical actuator 12 for actuating a braking control valve 14 and thereby controlling the supply of hydraulic fluid to a valve outlet port 16.

A supply 18 of hydraulic fluid, such as oil, under high pressure is provided on an hydraulic line 20 to a valve inlet port 22. The valve 14 also includes a sump outlet 24 for connection to an engine oil sump 26 through an interconnecting hydraulic line 28.

A hydraulic manifold 30 has a plurality of respective outlet ports 32, 34, 36, 38, etc. and an input port 40 so that hydraulic fluid delivered to the input port 40 is fluidly communicated to each of the outlet ports 32, 34, etc. The hydraulic inlet port 40 is connected to the braking control valve outlet port 16 by means of an hydraulic line 42.

A plurality of exhaust valve actuators 44, 46, 48, 50, etc. is provided with each respective exhaust valve actuator coupled to an associated engine exhaust valve. Thus, for a 6-cylinder engine having two exhaust valves per cylinder, there would be 12 exhaust valves and 12 exhaust valve actuators. Alternatively, the exhaust valves could be bridged so that one actuator would drive all the necessary exhaust valves in one cylinder.

As can be seen from FIG. 1, upon entering the engine braking mode, the ECM 4 supplies the desired timing output signal to the electrical actuator 12 which operates the braking control valve 14 so as to fluidly connect the hydraulic fluid from the high pressure supply 18 to the hydraulic manifold 30 and thereby simultaneously operate each of the exhaust valve actuators 44, 46, 48, 50. When the braking control valve 14 is not actuated, the hydraulic line 20 is blocked from the valve output port 16, and the outlet port 16 is instead connected to the sump outlet 24. Thus, at the end of the duration of the ECM 4 timing output signal the exhaust valves are simultaneously closed.

Figure 4:
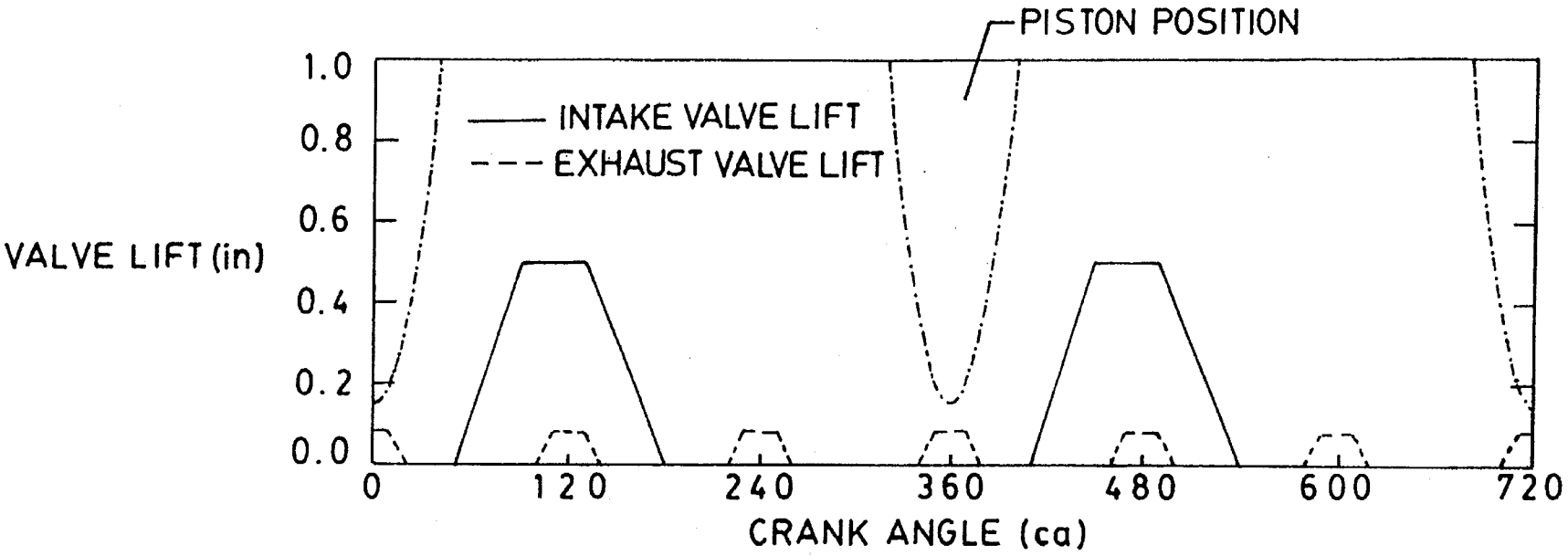
FIG. 4 is a schematic diagram illustrating the sequence of events useful in explaining the present invention.

FIG. 4 illustrates that, during braking, the exhaust valve actuators are operated three times during a crankshaft rotation between 0° and 360°, assuming the previously indicated multi-cylinder engine having six combustion cylinders. Thus, the exhaust valves are opened every 120° in the crankshaft rotation for about 40° duration. FIG. 4 illustrates that one exhaust valve opening occurs for instance centered at the 0° crankshaft angle in the vicinity of piston TDC to provide the compression release which performs the braking function. Actually, two engine cylinders will have their respective pistons in the vicinity of piston TDC at each 120° of crankshaft rotation. FIG. 4 illustrates the sequence of events during the engine braking mode and it can be seen that the intake valves are in the two cycle mode.

Figure 2:
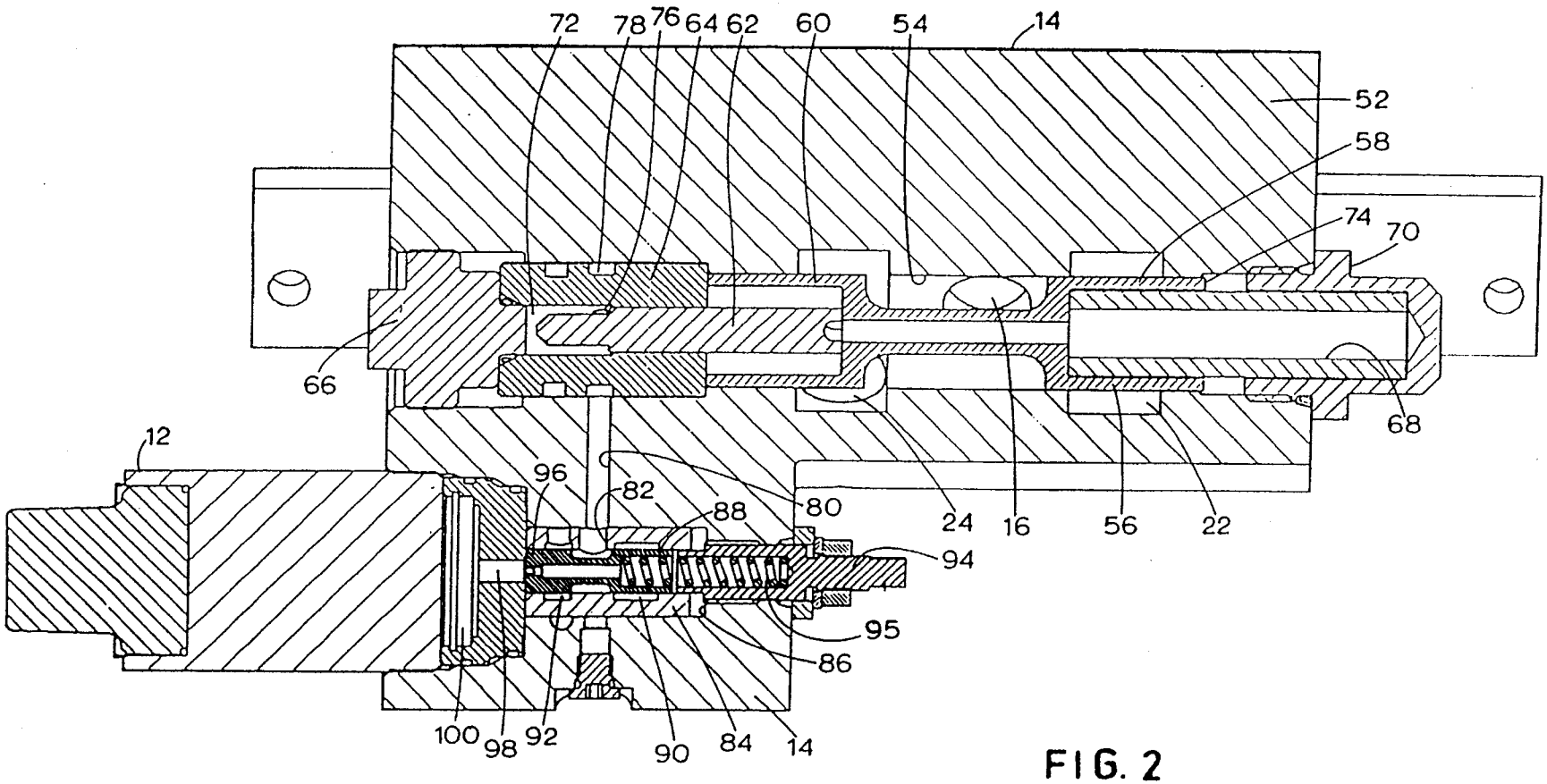
FIG. 2 is a schematic cross-sectional view illustrating an electronically controlled hydraulically operated braking control valve.
Figure 3:
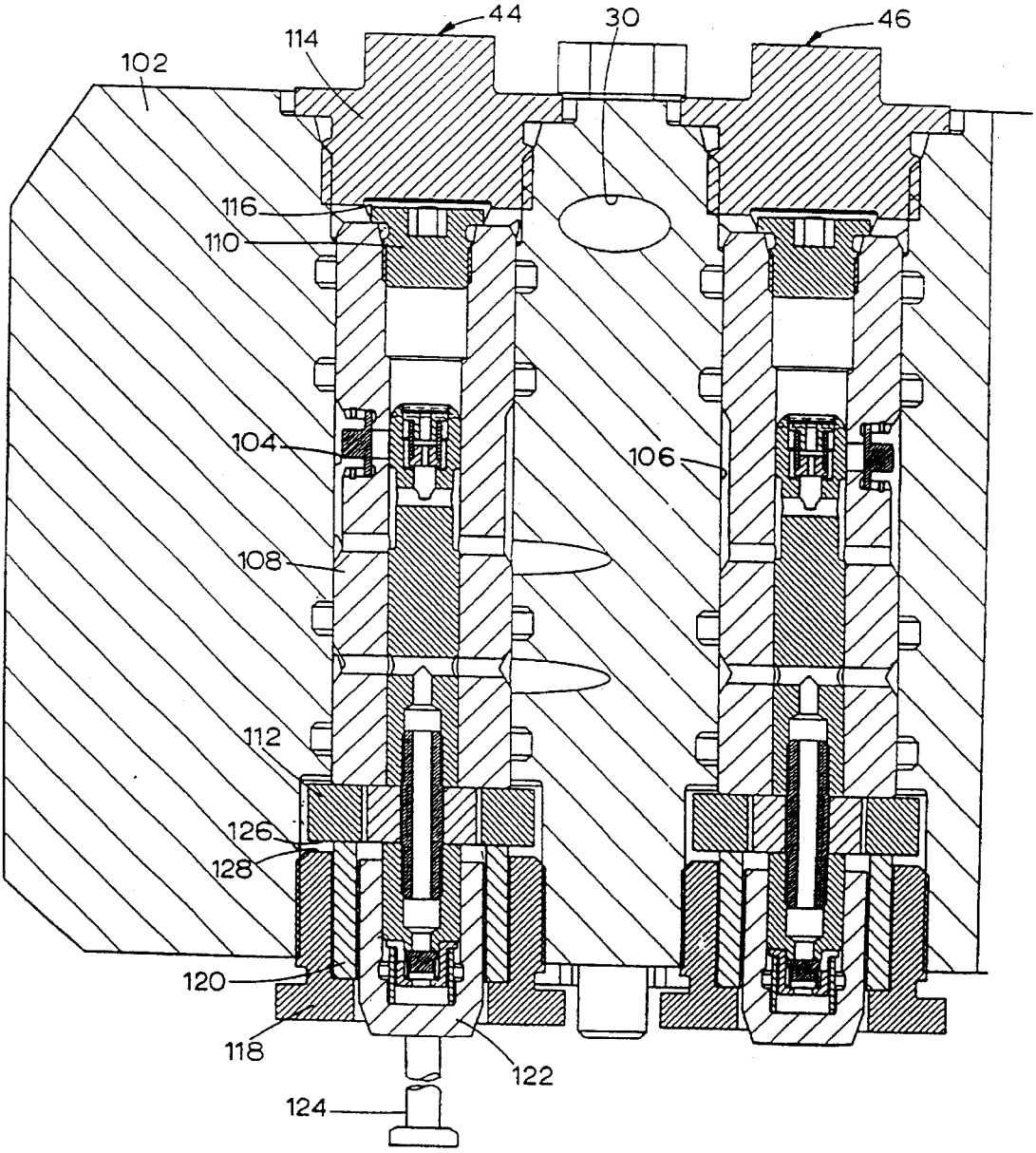
FIG. 3 is a schematic cross-sectional view illustrating two hydraulically operated exhaust valve actuators.

With reference to FIGS. 2 and 3, there is illustrated an embodiment of the invention forming the electrical actuator 12, the braking control valve 14, and the exhaust valve actuators 44, 46—for practicing the present invention. The braking control valve 14 includes a housing 52 containing a through bore 54 with suitable cavities forming the outlet port 16, the sump outlet 24 and the inlet port 22.

Within the through bore 54, there is slidably mounted a spool valve 56 containing a first extended portion 58 adapted so as to extend across the inlet port 22 and a second extended portion 60 adapted so as to extend across the sump outlet 24. The spool valve 56 abuts a plunger portion 62 extending from one end of the spool valve 56 for slidable disposition within a guide barrel 64. Guide barrel 64 is press fitted in the through bore 54 and is maintained in position by a plug 66 threadably mounted in the through bore and snug fit engaging the guide barrel 64. At the other end of the through bore, a return spring 68 is mounted against one end of the spool valve 56 and a stop plug 70 at the other end which in turn is threadably engaged within the bore 54. In the position shown in FIG. 2, the return spring 68, which can be a helical compression spring, maintains the spool valve 56 abutted against the guide barrel 64.

The plunger 62, the guide barrel 64, and the plug 66 form and define a pressure chamber 72 so that the introduction of high pressure hydraulic fluid into the pressure chamber 72 can move the spool valve 56 until a spool valve end 74 abuts against the stop plug 70. There can be seen from FIG. 2, in the nonoperated position of the spool valve 56, the return spring 68 butts the spool valve 56 against the guide barrel 64 so that the inlet port 22 is blocked from the outlet port 16. When suitable hydraulic pressure is supplied in the pressure chamber 72, the spool valve 56 moves to the right as shown in FIG. 2 so as to close off the sump outlet 24 and fluidly interconnect the inlet port 22 with the outlet port 16.

A cross-drilled hole 76 communicates at one end with the pressure chamber 72 and at the other end with an annular groove 78 formed in the guide barrel 64. A control passage 80 in the housing 52 fluidly communicates with the annular groove 78 at one end and with a pilot chamber 82 formed within a stationary sleeve 84 inserted in a pilot bore 86 in the housing 52.

A pilot spool valve 88 slidably mounts within the sleeve 84 for controlling fluid communication between a high pressure outlet chamber 90 and the pilot chamber 82. Through suitable passageways (not shown) in the housing 52, the high pressure outlet chamber 90 fluidly interconnects with the high pressure line 20 connected to the source of high pressure hydraulic fluid 18. A sump chamber 92 is connected to suitable passageways (not shown) in the housing 52 to the sump hydraulic line 28. An adjustable pilot stop 94 is threadably mounted within the pilot bore 86 to provide a stop for the pilot spool valve 88. A pilot return spring 95 biases the pilot spool valve 88 away from the pilot stop 94.

A pilot spool valve end 96 is connected to a piston 98 and diaphragm 100 for operation by the electrical actuator 12. Coupling of suitable electrical signals to the electrical actuator when entering the engine braking mode moves the diaphragm 100, piston 98, and the pilot spool valve 88 against the force applied by the pilot return spring 95 until the pilot spool valve abuts against the pilot stop 94. The movement of the pilot spool valve 88 is only about 1.1 mm., which is sufficient to fluidly communicate the high pressure outlet chamber 90 with the pilot chamber 82 so as to fluidly couple the high pressure hydraulic fluid through the control passage 80 and the cross drilled hole 76 into the chamber 72. When the actuating signals are removed from the electrical actuator 12, which occurs three times per crank rotation during the engine braking mode, the pilot return spring 95 forces the pilot spool valve 88 towards the left in FIG. 2 so as to block the high pressure chamber 90 from the pilot chamber 82 and in turn fluidly couple the pilot chamber 82 with the sump chamber 92. The movement of the pilot spool valve 88 to the left in FIG. 2 also allows the hydraulic fluid to flow from the pressure chamber 72 back through the control passage 80 and the pilot chamber 82 to the sump chamber 92. The return spring 68 forces the spool valve 56 toward the left in FIG. 2 so as to cover the inlet port 22 and fluidly connect the outlet port 16 to the sump outlet 24.

FIG. 3 illustrates the respective exhaust valve actuators 44, 46 for the two exhaust valves of cylinder no. 1. An exhaust valve actuator housing 102 includes respective channels 104, 106. Since the exhaust valve actuators 44, 46 are identical in construction, for convenience only one of the actuators, 44, will be described, it being understood that the remaining actuator 46 is of identical construction. A cylindrical guide barrel 108 has a plug 110 threadably engaged into the barrel 108 at one end and a projecting disc 112 held against the other end by the force applied by a return spring 120. At the top end of FIG. 3, a cap 114 is threadably engaged with the exhaust valve actuator housing 102 so as to define an actuating chamber 116 between the cap 114 and the plug 110. The actuating chamber 116 is fluidly interconnected through suitable passageways (not shown) in the housing 102 to the hydraulic outlet port 32 extending to the hydraulic manifold 30.

At the other end of the channel 104, there is provided a channel plug 118 threadably engaging the channel and having a hollow interior for accommodating the return spring 120 mounted between the channel plug 118 and the projecting disc 112. A valve lash adjuster 122 is mounted to the barrel 108 so as to maintain contact with an associated exhaust valve 124.

It can be seen that when high pressure hydraulic fluid is supplied to the braking control valve outlet 16 (FIG. 2) that this high pressure hydraulic fluid is coupled through the hydraulic manifold 30 to the actuating chamber 116 so as to move the barrel 108 downwardly until a lead surface 126 of the projecting disc 112 abutingly engages a stop surface 128 of the channel plug 118. This movement is sufficient to actuate the exhaust valve 124 so that the exhaust valve 124 only opens about 2 mm. As can be seen from FIG. 1, this actuator action by the braking control valve 14 simultaneously opens the exhaust valves in all six cylinders.

Figure 5:
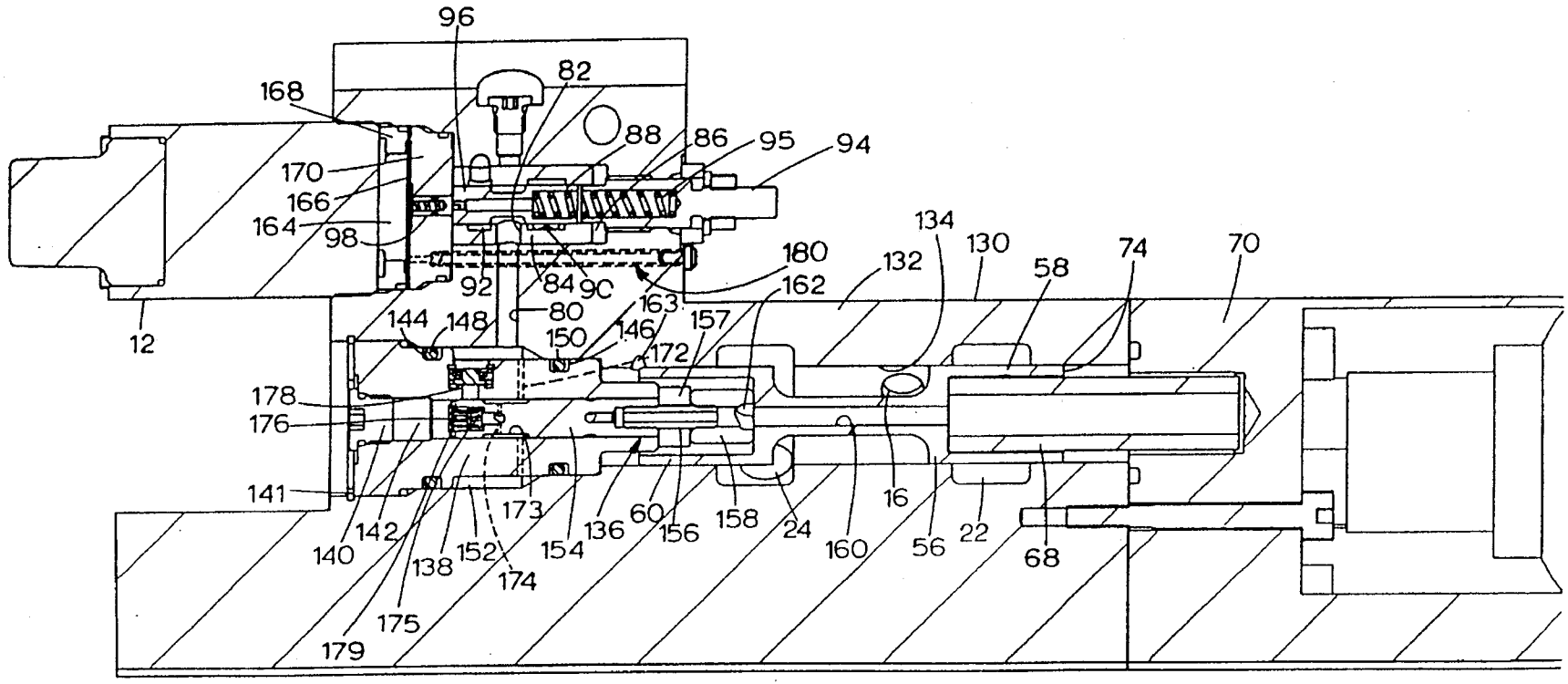
FIG. 5 is a schematic cross-sectional view illustrating a preferred embodiment of a braking control valve in accordance with the invention.

FIG. 5 is a schematic sectional view, similar to that of FIG. 2, of an alternative and preferred embodiment of the braking control valve of the present invention. Elements in FIG. 5 similar to those in FIG. 2 have like reference numerals. Now referring to FIG. 5, a braking control valve 130 includes a housing 132 containing a through bore 134 with suitable cavities forming the outlet port 16, the sump outlet 24 and the inlet port 22. Within the through bore 134 there is slidably mounted a spool valve 56 including a first extended portion 58 adapted so as to extend across the inlet port 22 and a second extended portion 60 adapted so as to extend across the sump outlet 24. The spool valve 56 abuts a plunger assembly 136 extending from one end of the spool valve 56 for slidable disposition within a guide barrel 138. The guide barrel 138 is closely fitted in the through bore 134. The guide barrel 138 is held axially within the through bore 134 by a retaining ring 141. A plug 140 is threadably mounted in the guide barrel 138. The plug 140 and the plunger assembly 136 define a cavity 142 within the guide barrel 138.

The guide barrel 138 includes annular notches 144 and 146 each of which may contain O-rings 148 and 150. The O-rings 148 and 150 sealingly engage the through bore 134. An annular chamber 152 is bounded by the through bore 134 and the guide barrel 138 between the O-rings 148 and 150. The plunger assembly 136 includes a plunger body 154, a stud 156 fixedly attached to the plunger body 154, a collar washer 157 fixedly attached to and surrounding the stud 156, and an adapter 158 which abuts the spool valve 56. The spool valve 56 includes an axial bore 160 and the adapter 158 includes a cross-drilled hole 162 to enable leakage of hydraulic fluid in the vicinity of the spring 68 to vent through a passage 163 in the housing 132 leading to the engine oil sump 26. This prevents compression lock of the spool 56 during its rapid travel sequence.

The braking control valve 130 also includes an electrical actuator 12 which drives a large piston 164. The large piston 164 in turn drives a diaphragm 166 which is clamped between spacers 168 and 170. The movement of the diaphragm 166 drives the piston 98 to the right in FIG. 5. Movement of the piston 98 to the right causes pilot spool valve 88 to move to the right, against the force applied by the pilot return spring 95, as described above in connection with FIG. 2. As in the embodiment depicted in FIG. 2, the movement of the pilot spool valve 88 fluidly couples the high pressure hydraulic fluid through the control passage 80, into the annular chamber 152 and into the cavity 142. This high pressure fluid enters the cavity 142 through cross-drilled holes 172 and 174 in the guide barrel 138 and the plunger body 154, respectively, and via an interconnecting annular chamber 173 opens a check valve 176 having a seating velocity orifice 175 therein. As high pressure fluid flows into cavity 142, the plunger assembly 136 is driven to the right in FIG. 5. The movement of the plunger assembly 136 to the right in FIG. 5 pushes the spool valve 56 to the right, thereby fluidly coupling the input port 22 and the outlet port 16. As the plunger body 154 continues to move to the right, the cross-drilled hole 172 in the guide barrel 138 is blocked from the annular chamber 173 and high pressure fluid no longer enters the cavity 142 and the movement of the plunger assembly 136 and the spool valve 56 is quickly stopped by the resistance of the return spring 68.

When the electrical actuator 12 is de-energized, the high pressure fluid in the annular chamber 152 is vented through the control passage 80 and into the sump chamber 92. A hat-shaped check valve 178 in the guide barrel 138 fluidly coupling the cavity 142 and the annular chamber 152 is forced open by the high pressure fluid in the cavity 142, thereby venting high pressure fluid from the cavity 142 into the control passage 80 and the sump chamber 92. This allows spring 68 to push spool valve 56 and plunger assembly 136 to the left in FIG. 5. As the plunger body 154 moves to the left, hat-shaped check valve 178 is gradually blocked from the cavity 142 by a tapered outlet check shut off edge 179 on the plunger body 154 and the fluid remaining in cavity 142 is forced through the seating velocity orifice 175 to slow and stop the movement of plunger assembly 136 and spool valve 56 as the collar washer 157 seats against the guide barrel 138.

In this embodiment spool valve 56 is prevented from impacting the housing 132 by the rapid decoupling of the driving high pressure hydraulic fluid and the spring 68 in one direction of spool valve movement and the fluid in cavity 142 in conjunction with the restriction of flow through the seating velocity orifice 175 rapidly slowing the motion in the other direction of spool valve movement. The geometry of the tapered outlet check shut off edge 179 and the seating velocity orifice 175 are tailored to ensure smooth operation and to prevent the plunger body 154 from bouncing uncontrollably during operation.

An air bleeding assembly in accordance with known techniques, shown generally at 180, is used to bleed air from the hydraulic system during initial operation.

Industrial Applicability

When the present invention is applied to a multi-cylinder engine, such as 6-cylinder engine, several significant advantages over other types of engine braking systems can be obtained. As can be seen from FIG. 4, in the engine braking mode, a two cycle operation is provided although during normal engine operation the engine may function as a four cycle reciprocating engine. Accordingly, during each 120° of crankshaft rotation within two cylinders a respective exhaust valve opening will occur in the vicinity of piston TDC to provide the compression release which performs the braking function and FIG. 4 illustrates that the inlet valves also operate in the two cycle mode in synchronism with the exhaust valve action. Thus, during one crankshaft rotation, each of the six cylinders will have contributed to the braking function.

Also, since during this same period of time when one piston is near TDC in a first cylinder, the exhaust valve of the adjacent cylinders are opened so that some of the air released in the compression release process will flow into those cylinders. For those cylinders which are still in the early stages of the compression stroke, raising the cylinder pressures will significantly increase the pressures during the balance of the compression stroke so as to significantly increase the braking effort. This can be seen with reference to FIG. 4, wherein the opening of the exhaust valve at 240° occurs while the cylinder is in the early stages of compression thereby allowing the cylinder pressure to build up and increase the braking function.

Figure 6:
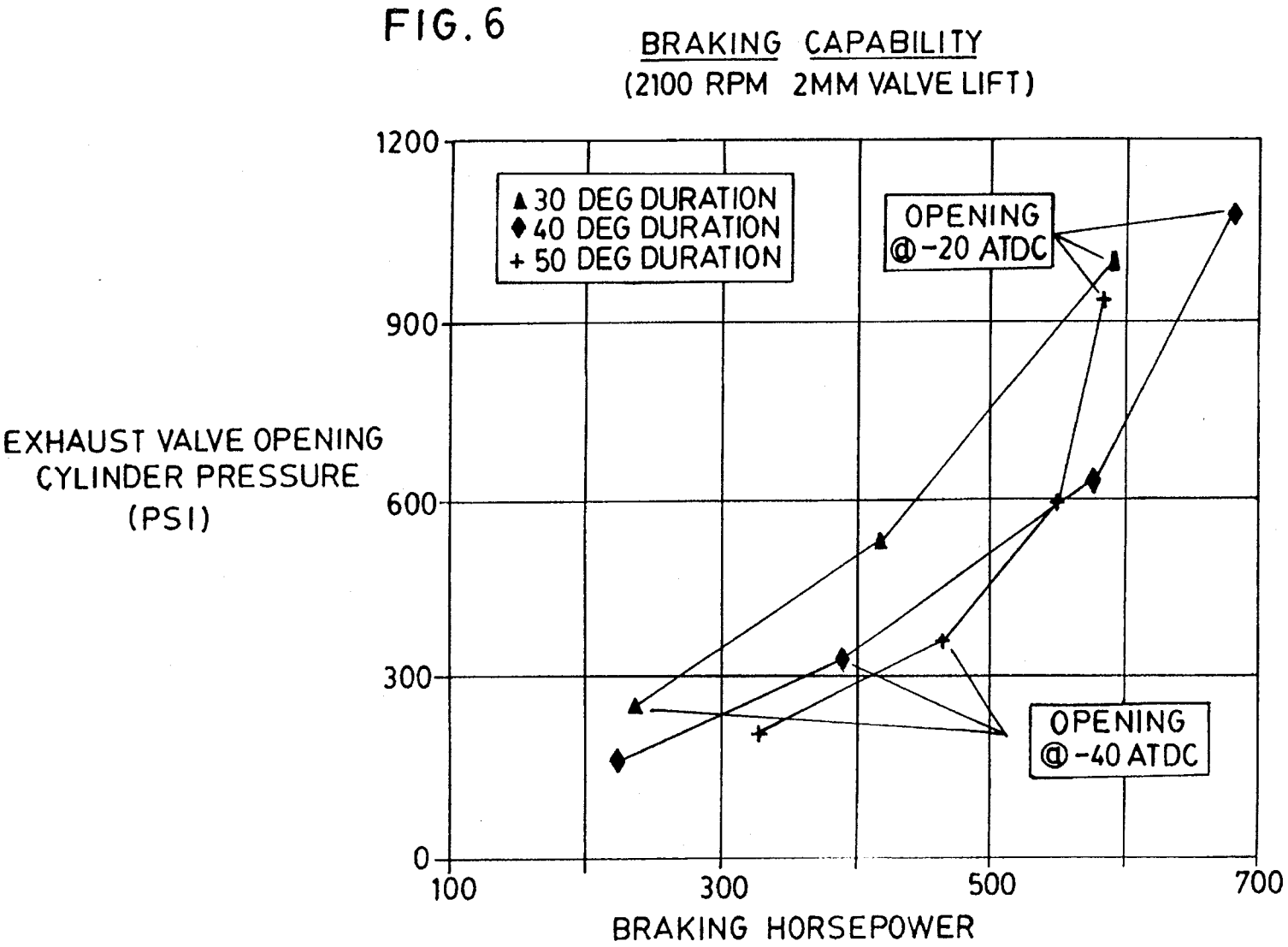
FIG. 6 is a graph illustrating braking power as a function of compression release timing of an exemplary internal combustion engine.

The braking power can be controlled by the ECM 4 by varying the exhaust valve opening timing and the duration of time that the exhaust valves are maintained in an open position. The level of braking may be determined by the ECM 4 in response to a manual control command by the operator, a cruise control system command, or an automatic braking system command. FIG. 6 shows the braking power attainable from an exemplary engine as a function of the exhaust valve timing actuation and the duration that the exhaust valves are opened at an engine speed of 2100 RPM and with 2 mm. of valve lift.

Figure 7:
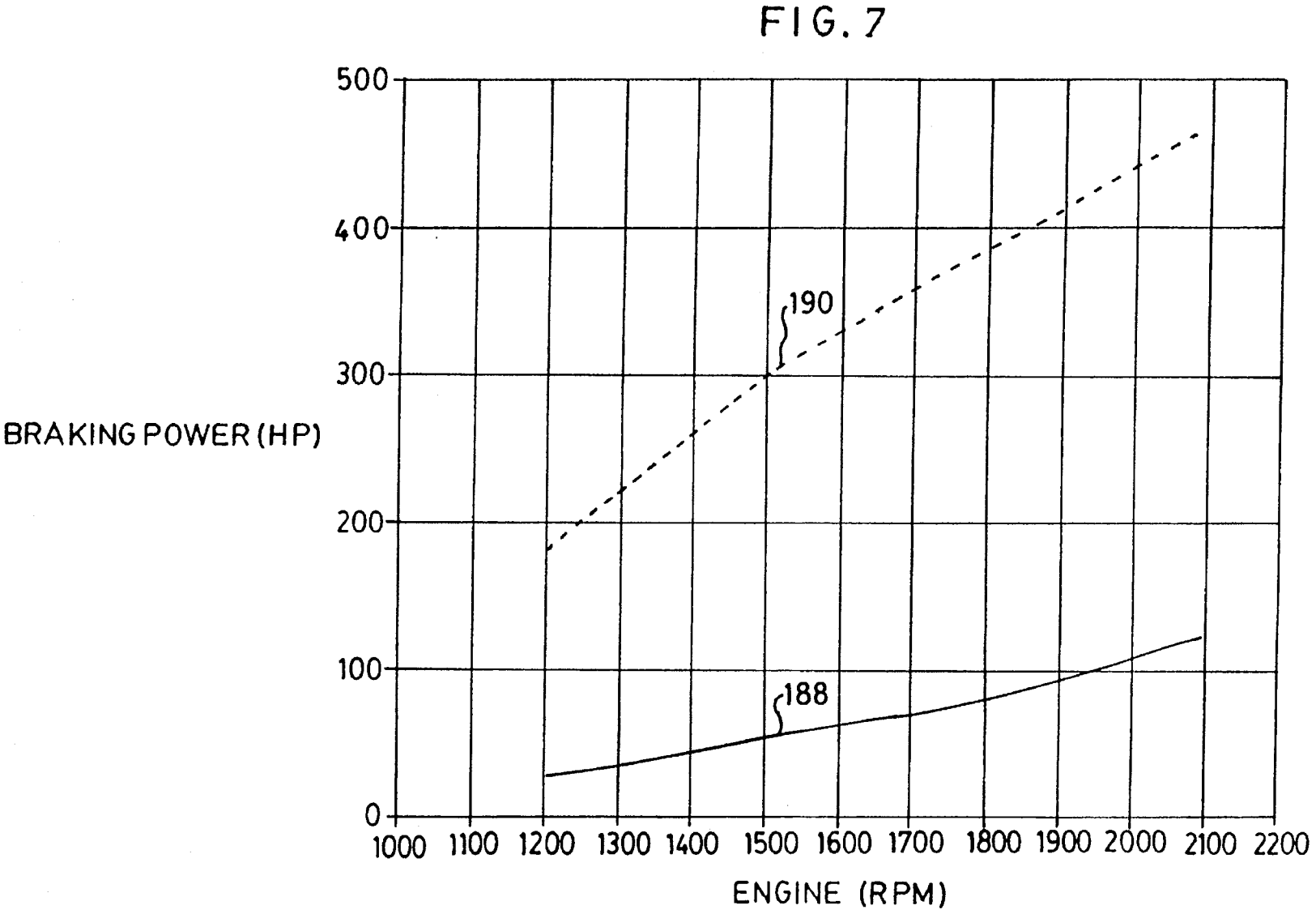
FIG. 7 is a graph illustrating available braking power as a function of engine speed for an exemplary internal combustion engine.

FIG. 7 shows that at a given engine speed, a range of braking power can be achieved. The lower curve 188 in FIG. 7 represents the braking power produced by motoring friction (braking due to frictional losses in the engine without the use of an engine brake). The upper curve 190 in FIG. 7 represents the braking power available as a function of engine speed, while staying within the structural limits of the engine. Again, the level of braking power may be varied between the available level and the motoring friction level by the ECM 4 controlling (1) the timing of the exhaust valves opening with respect to piston TDC, and (2) the duration of the opening of the exhaust valves.

A second advantage of the present invention is in providing a fail safe engine to prevent severe engine damage when the electronic actuation sequence fails. For example, to allow pressures to be reduced in all cylinders, actuation of the single braking control valve 14 can safely open all of the exhaust valves a predetermined amount. This not only allows the pressures to be reduced and also avoids piston to exhaust valve contact.

In operating the system of the present invention, the ECM 4 timing output signal actuation of the electrical actuator 12 forces hydraulic fluid under high pressure into the chamber 72 to move the spool valve 56 to the right in FIG. 2 so as to fluidly communicate the high pressure hydraulic fluid from the high pressure supply 18 at the valve inlet port 22 to the outlet port 16 connected to the hydraulic manifold 30. This places the high pressure hydraulic fluid required to actuate each of the exhaust valves at the manifold 30 which in each exhaust valve is coupled to an actuating chamber 116. This simultaneously drives each of the barrels 108 and lead surfaces 126 against the stop surface 128 to open the respective exhaust valve 124. Opening of the exhaust valves occurs three times in each revolution of the crankshaft as shown in FIG. 4.

During the engine braking mode, the signal to electrical actuator 12 is removed three times each crankshaft rotation so that the return spring 68 can return the spool valve 56 to the resting position shown in FIG. 2. The pilot spool valve 88 is moved to the left resting position shown in FIG. 2 thereby venting the hydraulic fluid to the sump 26. Also, the return spring 120 in the exhaust valve actuator acting against the projecting disc 112 moves the barrel 108 back to the resting position shown in FIG. 3.

A significant advantage of the preferred braking control valve 130 of FIG. 5 compared to the braking control valve 14 of FIG. 2 is in the prevention of contact between the spool valve end 74 and the stop plug 70 when the spool valve is rapidly driven to the right in FIG. 5 by the high pressure hydraulic fluid in cavity 142. This enables the spool valve 56 to be rapidly moved to the right in FIG. 5 and yet to be quickly disengaged from the driving hydraulic fluid pressure by fluidly decoupling the cavity 142 from the cross-drilled hole 172. The spring 68 assists in preventing undesired contact of the spool valve 56 with the stop plug 70. Also, as noted previously, when the spool valve 56 is moved to the left in FIG. 5 by the spring 68, the action of the hat-shaped check valve 178 allows the fluid to be rapidly evacuated from the chamber 142. The tapered outlet check shut off edge 179 then blocks fluid flow through the hat-shaped check valve 178 and forces all fluid flow through the seating velocity orifice 175 thereby rapidly increasing the pressure in cavity 142 and rapidly decelerating the spool valve 56. Thus the spool valve 56 is rapidly driven during operation and yet is enabled to effectively decelerate at its two operating end points rather than undesirably impacting the stop plug 70 and the guide barrel 138 at the operating end points.

When the engine is switched to the compression braking mode, both the inlet and exhaust valve actions are switched to function as a two cycle engine. The operation of the inlet valves in the two cycle mode enables complete cylinder filling on each stroke to maximize the braking capability of the engine. The present invention would provide similar improvements to a two cycle engine when running in the compression braking mode. The time of the exhaust manifold pressure waves is very optimum for a six cylinder in-line engine, but operation of other engine configurations could be improved using this invention based on pressure wave analysis techniques commonly available to the industry.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. An engine compression braking system for a multicylinder engine wherein compressed air used during the compression stroke is used for engine braking and the compressed air is released through the cylinder exhaust valve near piston top dead center, said engine compression braking system comprising:

a plurality of hydraulically operated exhaust valve actuators, each having an hydraulic input and an hydraulic output, each hydraulic output coupled to a respective cylinder exhaust valve for opening the respective exhaust valve upon hydraulic operation of the associated exhaust valve actuator;

an hydraulically operated braking control valve having a controlled hydraulic output coupled to each of said hydraulic inputs of said exhaust valve actuators; and actuator means for actuating said braking control valve to simultaneously hydraulically operate said plurality of exhaust valve actuators and for in turn simultaneously opening all of the exhaust valves in the engine.

2. An engine compression braking system according to claim 1, wherein each of said plurality of hydraulically operated exhaust valve actuators includes stop means for limiting the opening of said respective exhaust valve to a predetermined amount.

3. An engine compression braking system according to claim 1, wherein said braking control valve includes a first port for connection to a high pressure hydraulic source, and a valve element actuated by said actuator means for hydraulically interconnecting said first port and said controlled hydraulic output.

4. An engine compression braking system according to claim 3, wherein said braking control valve further includes a second port for connection to an hydraulic sump, said valve element actuated by said actuator means for hydraulically interconnecting said first port and said controlled hydraulic output in one actuation direction; and said valve element movable in the opposite direction to hydraulically interconnect said controlled hydraulic output and said second port.

5. An engine compression braking system according to claim 4, wherein said braking control valve includes a return spring coupled to said valve element to move said valve element in the opposite direction.

6. An engine compression braking system according to claim 5, wherein said valve element is an hydraulically actuated spool valve.

7. An engine compression braking system according to claim 1, wherein said actuator means includes an electro-hydraulic actuator responsive to an electrical signal input and providing an hydraulic fluid pressure drive for operating said hydraulically operated braking control valve.

8. An engine compression braking system according to claim 7, wherein said electrohydraulic actuator means includes a pilot spool valve operably driven from a rest position for controlling the fluid coupling of said hydraulic fluid pressure drive to said braking control valve.

9. An engine compression braking system according to claim 8, wherein said braking control valve includes a return spring coupled to said valve element in said braking control valve for returning said pilot spool valve to the rest position.

10. An engine compression braking system according to claim 3, wherein said braking control valve includes fluid coupling means (1) for intercoupling said valve element and said actuator means for hydraulically operating and rapidly driving said valve element in an actuation direction towards one operating end of the valve stroke, and (2) for decoupling said valve element and said actuator means for disabling the driving of said valve element in the actuation direction.

11. An engine compression braking system according to claim 10, wherein said braking control valve includes a return spring coupled to said valve element to move said valve element in the opposite direction towards the opposite return end of the valve stroke, so as to enable the valve element to effectively float between said operating and return ends of the valve stroke.

12. An engine compression braking system according to claim 1, including an hydraulic manifold having an input coupled to said braking control valve controlled hydraulic output, said hydraulic manifold also having a plurality of manifold outlets each coupled to a respective exhaust valve actuator hydraulic input.

13. An engine compression braking system according to claim 1, wherein said actuator means includes means for timing the actuation of said braking control valve with respect to piston top dead center to control the timing of the simultaneous opening of all of the exhaust valves with respect to piston top dead center.

14. An engine compression braking system according to claim 13, wherein said actuator means further includes means for timing the deactuation of said braking control valve to control the duration of the simultaneous opening of all of the exhaust valves so as to select a corresponding amount of braking horsepower.

15. An engine compression braking system for a multi-cylinder engine wherein compressed air used during the compression stroke is used for engine braking and the compressed air is released through the cylinder exhaust valve near piston top dead center, said engine compression braking system comprising:

actuator means for simultaneously opening all of the exhaust valves in the engine at a selected timing with respect to piston top dead center;

deactuator means for simultaneously closing all of the exhaust valves in the engine to control the duration of said opening so as to select a corresponding amount of braking horsepower.

16. An engine compression braking method for a multi-cylinder engine wherein compressed air used during the compression stroke is used for engine braking and the compressed air is released through the cylinder exhaust valve near piston top dead center, said engine compression braking method comprising the steps of:

providing a plurality of hydraulically operated exhaust valve actuators, each having an hydraulic input and each coupled to a respective cylinder exhaust valve for opening the respective exhaust valve upon hydraulic operation of the associated exhaust valve actuator;

providing an hydraulically operated braking control valve having a controlled hydraulic output coupled to each of said hydraulically operated exhaust valve actuators; and actuating said hydraulically operated braking control valve during an engine braking cycle for simultaneously hydraulically operating said plurality of exhaust valve actuators and for in turn simultaneously opening all of the exhaust valves in the engine.

17. The engine compression braking method according to claim 16, including simultaneously opening all of the exhaust valves in the engine several times during the engine braking cycle.

18. An engine compression braking method for a multi-cylinder engine wherein compressed air used during the compression stroke is used for engine braking and the compressed air is released through the cylinder exhaust valve near piston top dead center, said engine compression braking method comprising the steps of:

simultaneously opening all of the exhaust valves in the engine at a selected timing with respect to piston top dead center; and simultaneously closing all of the exhaust valves in the engine to control the duration of said opening so as to select a corresponding amount of braking horsepower.

* * * * *